United States Patent [19]

Arnold

[11] 4,371,018

[45] Feb. 1, 1983

[54] DEVICE FOR REPAIRING POLES FOR SUPPORTING ELECTRIC POWER TRANSMISSION LINES AND THE LIKE

[76] Inventor: Victor Arnold, 3 Fairfax St., Mosman, New South Wales, 2088, Australia

[21] Appl. No.: 187,994

[22] Filed: Sep. 17, 1980

[30] Foreign Application Priority Data

May 26, 1980 [AU] Australia ..... PE03723

[51] Int. Cl.[3] ..... B27C 9/00

[52] U.S. Cl. ..... 144/4; 29/401.1; 144/2 R; 254/30; 405/303

[58] Field of Search ..... 144/2 R, 136 H, 134 R, 144/4; 29/402.1, 401; 254/30, 31, 106; 405/303

[56] References Cited

U.S. PATENT DOCUMENTS 3,911,548 10/1975 Perry ..... 29/401

FOREIGN PATENT DOCUMENTS

22674/35 2/1936 Australia .

OTHER PUBLICATIONS

Longer Concrete Base for Higher Poles; Utility Methods, Electrical World, Jan. 15, 1980.

Mod/Pole; Tech. News, Issue 1, vol. 1 (Interpace).

*Primary Examiner*—W. D. Bray

[57] ABSTRACT

A method and apparatus for lengthening or shortening a pole supporting lines, such as electric power and telephone lines. The method includes the providing of a stub adapted to be joined in abutting end-to-end relationship with the lower end of the pole to form a lower extension and support for the pole. The pole is raised vertically until its lowermost end portion is clear of the ground so that a lower end portion of the pole can be sized, as necessary, for reception by a mechanism joining the pole and stub. If necessary, the length of the pole is also shortened to provide a desired combined length. After the lower end has been sized, the pole and stub are joined to each other so that they constitute, in effect, a substantially rigid continuation of each other. The pole and stub are then vertically lowered into the ground to a required depth and the ground is consolidated around the base of the stub. The apparatus includes appropriate structure for accomplishing the preceding method.

2 Claims, 12 Drawing Figures

DEVICE FOR REPAIRING POLES FOR SUPPORTING ELECTRIC POWER TRANSMISSION LINES AND THE LIKE

This invention relates to poles such as wood poles and like supports, such as for electric power or telephone transmission lines, said supports being of a type prone to deterioration such as by termite, fungal and other infestation in the wood at or below ground level.

The consequences of such deterioration are likely to be serious. Weakened poles are prone to collapse, especially when exposed to high winds, and (especially if this should happen in a remote place) can as a result leave wide areas without electric power or telephone communications for long periods of time. Furthermore, hot molten metal particles in the form of electric sparks from fallen, damaged or crosssed wires attached to such poles can cause serious fires.

In the past, wood poles or supports have been impregnated with fungicides, insecticides or other chemical repellents, or have been otherwise treated in an attempt to prevent, delay or halt the degradation of timber at the groundline. However it can be said, in general, that such attempts have not been completely satisfactory.

An object of our invention is to refurbish and thereby improve the efficacy, reliability, stability and/or safety especially of such poles as have been subjected to or are prone to attack by termites, fungi and/or water.

A further object is to carry out such improvements without substantial interruption of the normal function of the poles e.g. to the normal flow of electricity in wires carried by the poles.

The above and other objects and advantages will become apparent from the ensuing description.

Accordingly, the present invention provides a method of lengthening an electric power or telephone line supporting or like pole and/or of restoring such a pole rendered unsafe such as by termite infestation causing deterioration of a wooden portion thereof with consequent strength loss at or near ground level, said method including the provision of a stub adapted to be joined in abutting end-to-end relationship with the lower end of the pole to form a lower extension continuation and support for the pole, raising the pole vertically until its lower end is clear of the ground, sizing a lower end portion of the pole as necessary for reception by junction means and for obtaining the desired combined length of sized pole and stub, applying said means to join the sized pole and stub, so that the one constitutes in effect a substantially rigid continuation of the other, vertically lowering the pole with its extension into the ground which has been prepared for receiving the lengthened and/or restored pole to the required depth, and consolidating the ground around its base.

But in order that the invention may be better understood, reference will now be made to the accompanying drawings which are to be considered as part of this specification and read herewith. In the drawings.

Figure 1:
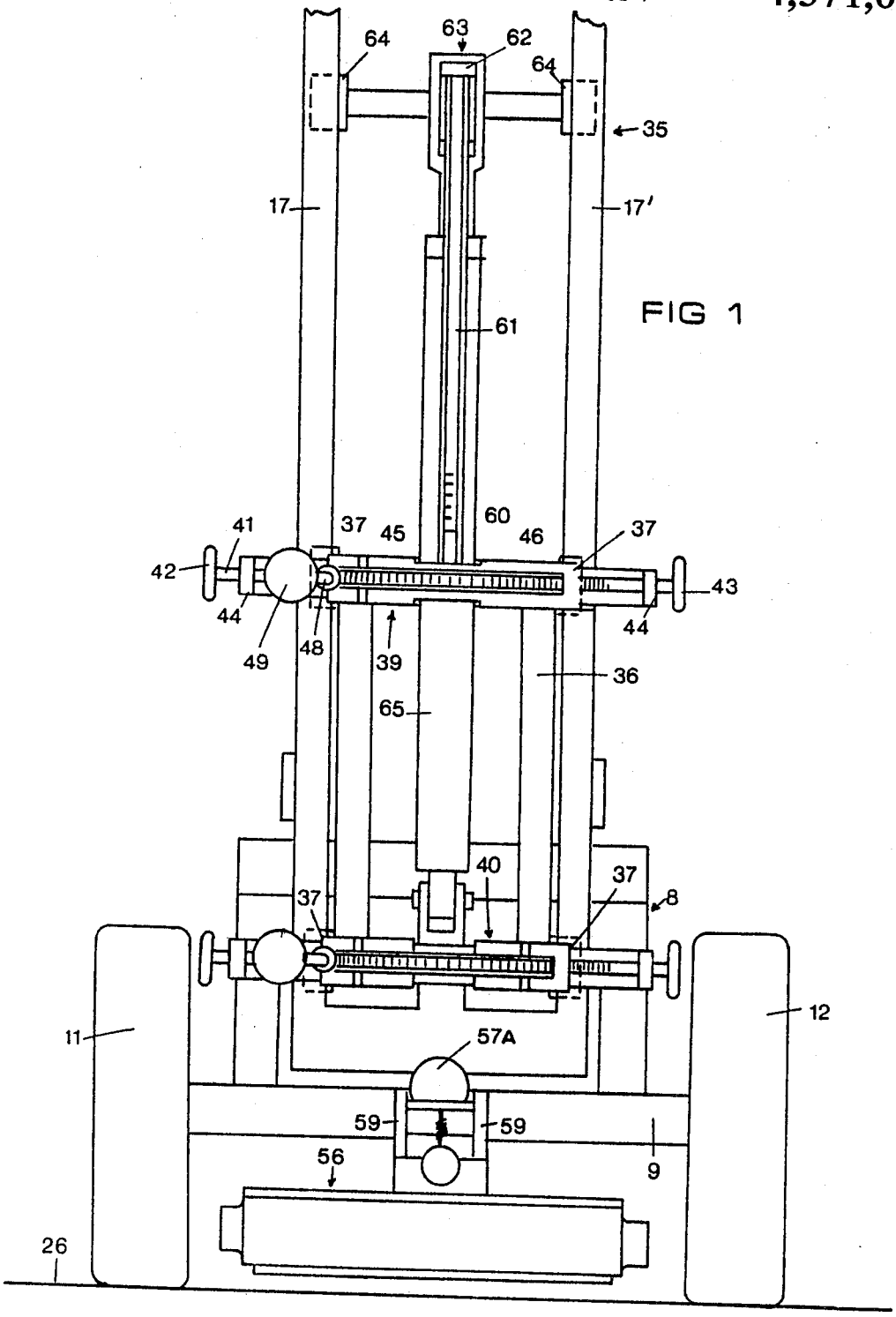
FIG. 1 is a rear elevation showing part of a practical embodiment of a truck-mounted apparatus for use in carrying out the invention.

Referring to the drawings in more detail, the apparatus includes a base frame 8 fixed to the tray 9 of truck 10 having rear wheels 11 and 12. Additional support for the apparatus is provided by retractable and rearwardly inclined stabilizing legs 13, 14 and stays 15, 16 the latter being fixed to an upper portion of a carriage guide 17 to be more fully described hereinafter.

The apparatus illustrates a lengthening and restoration of pole 18 which has been rendered unsafe due to loss of strength in portion 19 at or near ground level. For this purpose the pole is trimmed as necessary by cutters 20 of cutting assembly 21, for reception in junction means in the form of a peripherally-continuous sleeve 22 whereby the trimmed pole is adapted to be underpinned by a cylindrical, prismatic or other suitably-shaped column or stub 23 of steel, reinforced concrete or other material of suitable durability strength and resistance to the relevant prevailing or foreseen type or types of strength erosion.

Stub 23 may be about 2.5 m or more in height and may support foot 24 of the sized pole at a height of about 0.25 m above ground level 26, or at a suitable height up to about 0.25 m. Sleeve 22 is of steel or other appropriate material and of a length about $5 \times D$, where D is the pole diameter, and may extend for about half of its length above, and one half below, the abutment 27, between pole 18 and stub 23. The relevant base portions of sleeve 22 and stub 23 may be sunk to such depth as affords adequate support for the pole and meets prevailing statutory and other requirements.

The hoisting apparatus may be generally hydaulic in operation and the motive mechanism may include a hydraulic pump and reservoir 28 and 29 respectively. The mechanism has a sub-assembly pivoted at 30 to base frame 8 for movement by means of hydraulic ram 31 between a transport position (FIG. 4A) and an operative position (FIG. 4B). The hoist support frame may include an inclined strut 32 fixed at its lower end to base frame 8 and a rearwardly inclined member 33, of which the forward end is attached to an upper end portion of strut 32 and a rear end of which is fixed to the back of the base frame. Member 33 may be about the same length as the distance of its rearmost point from the lower end of strut 32, giving the framework 8, 32, 33 an isosceles-triangular appearance in side elevation. An extendible supporting prop 34 may be attached to the frame for supporting and stabilizing hoist 35 when erected for use in the operative position shown in FIG. 4B. Cam-action clamps, hydraulic rams or other suitable means may be provided for altering the effective length of the prop. A transverse frame member (not shown) may act as a rest for hoist 35 in the transport position. Provision may be made for lengthening stays 15, 16 in like manner to prop 34.

Hoist 35 is essentially a contrivance for grasping the pole by means of clamps adapted to raise and lower the pole vertically. It includes a carriage 36 adapted to be hydraulically raised and lowered through a maximum distance of about 3 meters along a pair of parallel guides 17, 17′ by means of rollers 37 mounted on lugs 38 projecting rearwardly from the main frame of carriage 36.

Carriage 36 carries upper and lower substantially identical chain clamp assemblies 39, 40.

Figure 3:
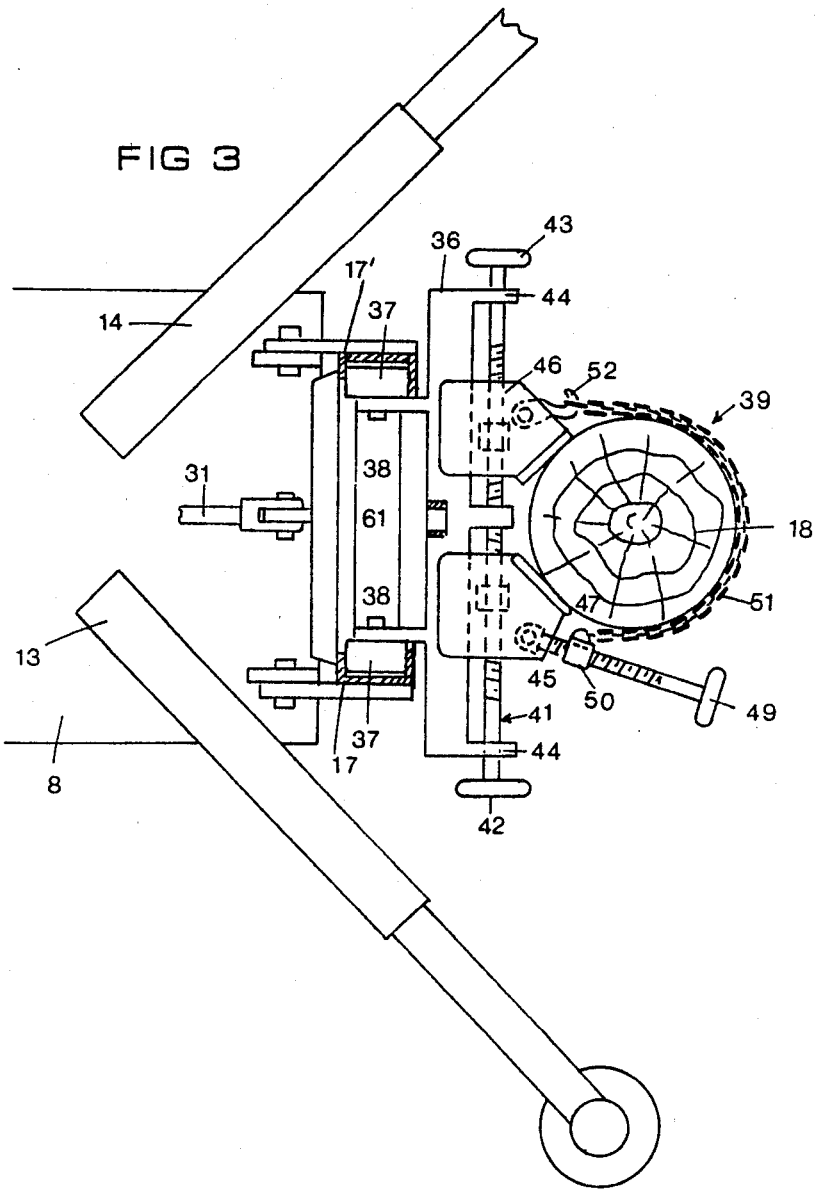
FIG. 3 is a section across line III—III in FIG. 2 however showing in addition stabilizing legs.

As best seen in FIG. 3, the (upper) assembly illustrated therein includes a transverse bar 41 rotatable in brackets 44 on the carriage and adapted to be turned by means of either of the handwheels 42, 43 fixed to its respective ends.

The respective halves of bar 41 are oppositely threaded so that turning the bar moves co-operating threaded blocks 45, 46 either towards or away from each other, in unison. Pivoted at 47 to block 45 for swinging movement in a horizontal plane is a threaded shaft 48 rotatable by wheel 49 and carrying nut 50 to which chain 51 may be attached and thence passed around part of the pole circumference and hooked to hook 52 on block 46. This hook is engaged with a selected link of chain 51, and excess chain may simply hang below the hook. Clamping is achieved by winding apart blocks 45 and 46, selecting a length of the chain appropriate to the girth of pole 18, winding blocks 45 and 46 towards each other and imposing such further tension as desired by turning 49.

To point 60 on carriage 36 is fixed chain 61 which passes up and back over pulley 62 which is freely rotatable on carriage 63 which is movable by means of rollers 64 in guides 17, 17′. From pulley 62 chain 61 passes downwards and is anchored to a fixed point (not shown) at a convenient location. Carriage 36 is raised by means of hydraulic ram 65 exerting an upward thrust on carriage 63 thereby raising 36 by the movable-pulley interaction of 62 and chain 61 anchored at its end (not shown) remote from load 36 to which it is attached at 60. The effect of this movable pulley contrivance is to raise 36 with twice the velocity of 63.

Figure 2:
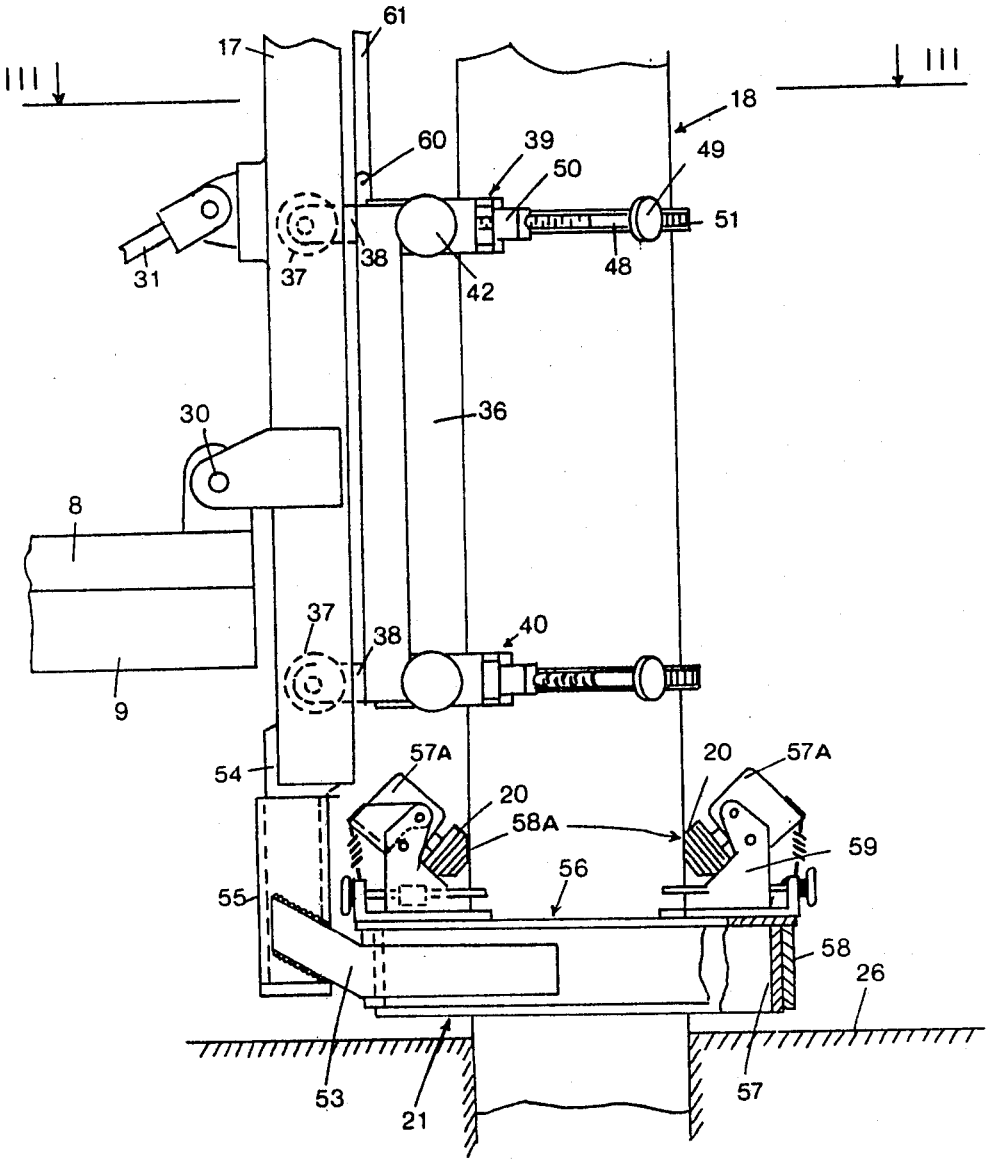
FIG. 2 is a part side-elevation of the apparatus of FIG. 1 showing the cutting base and the manner of gripping the pole.

Cutting assembly 21 is of generally ring-like formation adapted in an operative position to receive pole 18 for trimming by cutters 20. The assembly is mounted on shaft 54 (FIG. 2) depending from the lowest part of hoist 35, by means of sleeve 55 to which assembly 21 is rigidly connected cantilever-wise by means of bracket 53 for swinging movement between the operative (FIGS. 1, 2, 5B, 5C, and 7) and inoperative (FIGS. 4B, 4C, 5A, 6A and 6B) positions. A "Gee"-type clamp may be provided for locking assembly 21 in the desired position. As best seen in FIG. 2, cutters 20 are mounted on a sub-assembly in the form of a horizontal ring and depending therefrom a shallow cylindrical skirt or flange 57 adapted to form a close fit within a complementary flange 58 fixed with respect to the main assembly 21 to act as a guide for 180° rotation of the sub-assembly to and fro around pole 18 with cutters 20 engaged as shown in FIGS. 2 and 5C.

It will be clear that more than two cutters 20 could be provided if desired, and this would obviously reduce the required angular amplitude of relative rotation between 21 and 56, for the whole periphery to be trimmed.

If desired, means could be provided to shift 56 and 21 relatively, in order to adjust the center or axis of cutting in relation to the main hoist assembly 35.

Cutting assembly 21 has been specifically described and illustrated as a ring formation, requiring pole 18 to be lowered axially into it. As an alternative, although possibly a more complicated arrangement, there could be provided a jaw-like cutter assembly adapted to be swung into or out of the operative position without having to raise and lower the pole. Alternatively, the ring formation cutter assembly could be adapted for vertical movement co-axially with the pole. Thus the pole could be held stationary while the required length thereof is cut to the desired cross-section.

Each cutter 20 consists essentially of a plurality of rotary blades fixed to the output shaft of hydraulic motor 57A in a housing pivoted trunnion-wise to brackets 59 on sub-assembly 56 and spring-loaded so that the cutters 20 are forced into cutting relationship with pole 18 but can yield against the spring pressure if the cutters strike a hard foreign object such as a metal spike or staple embedded in the wood, or if the wooden pole is allowed to descend so quickly, relative to the cutters, as might otherwise "stall" motors 57A.

Figure 7:
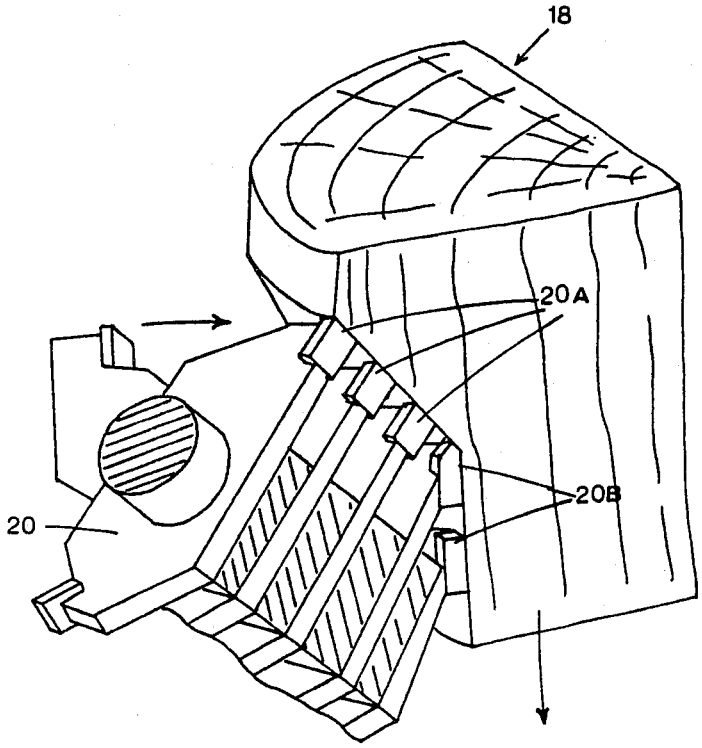
FIG. 7 shows portion of one of the cutter heads of the apparatus.

As best seen in FIG. 7, blades 20 comprise a first inner group 20A of primary cutters and a second outer group 20B of smoothing cutters the blades of which latter are bevelled so that in a normal position of use (FIG. 2) they cut a cylindrical band 58A of pole 18 as the cutter sub-assembly 56 is rotated around it. It will also be clear from FIG. 2, that as pole 18 is gradually lowered relative to the cutter assembly, the blades of the first group 20A will be the first to contact such wood as projects substantially radially beyond the upward continuation of the aforementioned cylindrical band. Hence 20A are regarded as the primary cutters, and 20B fulfil a trimming or smoothing function.

Cutters 20 may be mounted on lathe-type screw slides for ease of radius and centering adjustment. Means may also be provided for adjusting the speed of motors 57A and/or the tension of their spring mountings and/or means may be provided for changing the blades as desired so as to obtain a different configuration of blade contour or mode of cutting.

The invention as illustrated in the drawings will further be described by reference to a practical method of carrying out a process according to the invention.

Figure 4A:
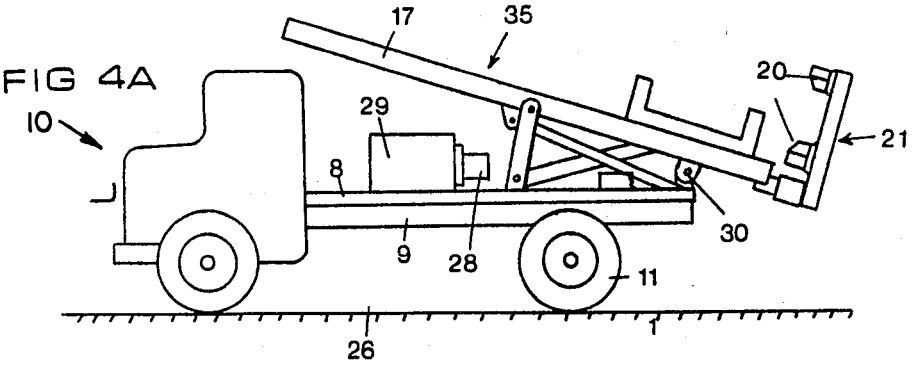
FIGS. 4A, 4B, 5A, 5B, 5C, 6A and 6B are schematic side elevations illustrating a sequence of operations in a practical method of carrying out the invention using the apparatus of FIGS. 1 to 3.
Figure 4B:
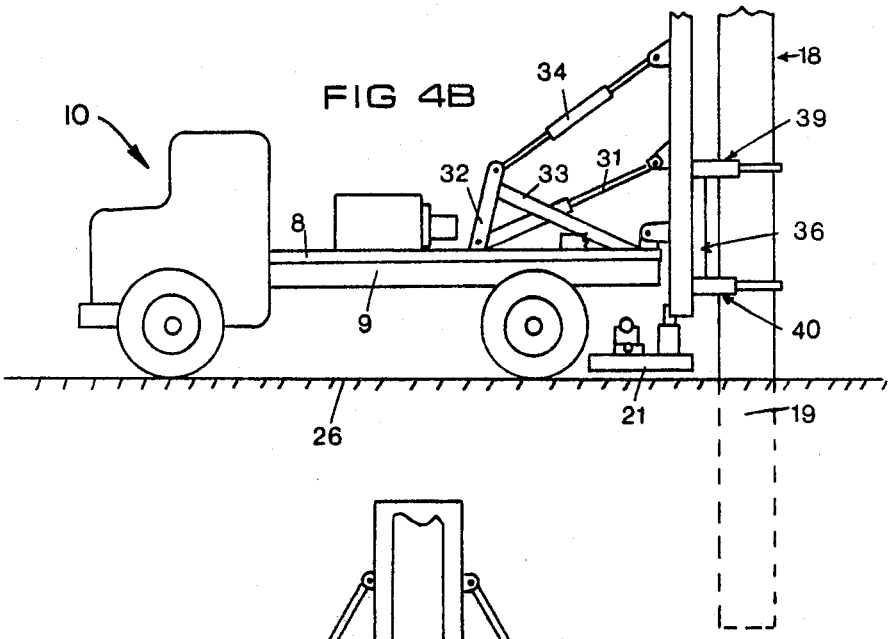
Figure 4C:
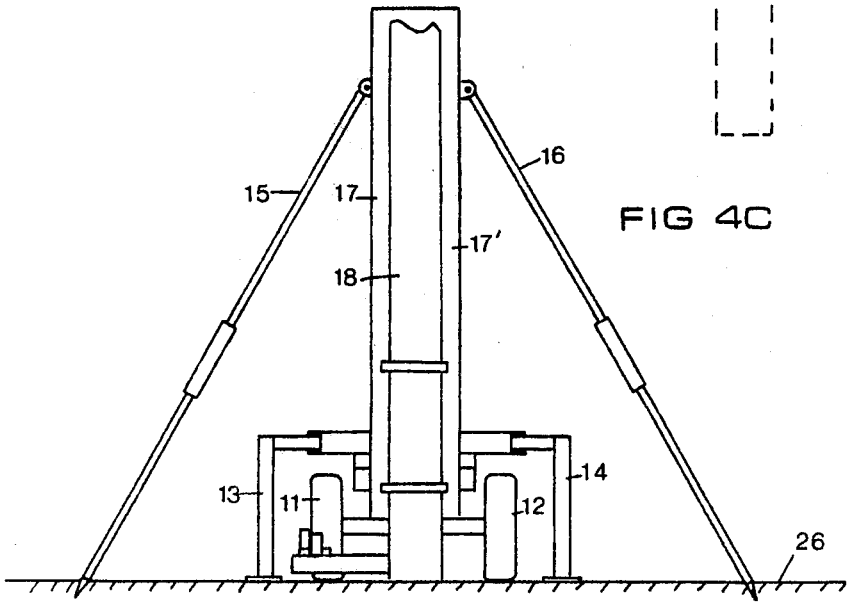
FIG. 4C is a schematic rear elevation corresponding to FIG. 4B but showing in addition stabilizing legs and stays.

The operators having checked the security and vertical clearance of the wires e.g. from adjacent trees, truck 10 with its burden of hoisting gear assumed to be in the transport position shown in FIG. 4A, is driven into a suitable position, and stabilizing legs 13, 14 are extended so that their feet contact the ground at points substantially in the same vertical (transverse) plane as the axis of pole 18. Ram 31 is actuated to raise hoist 35 and its ancillary gear to the vertical position (FIG. 4B). Stabilizing prop 34 may be connected and the ram and prop adjusted as necessary to render the plane of guides 17 parallel to the axis of pole 18. Clamp assemblies 39, 40 having beeen centred on pole 18, the clamps may be secured and tightened as hereinbefore described and the weight of the pole may be in effect taken by the truck wheels and/or the stabilizing legs 13, 14.

Figure 5A:
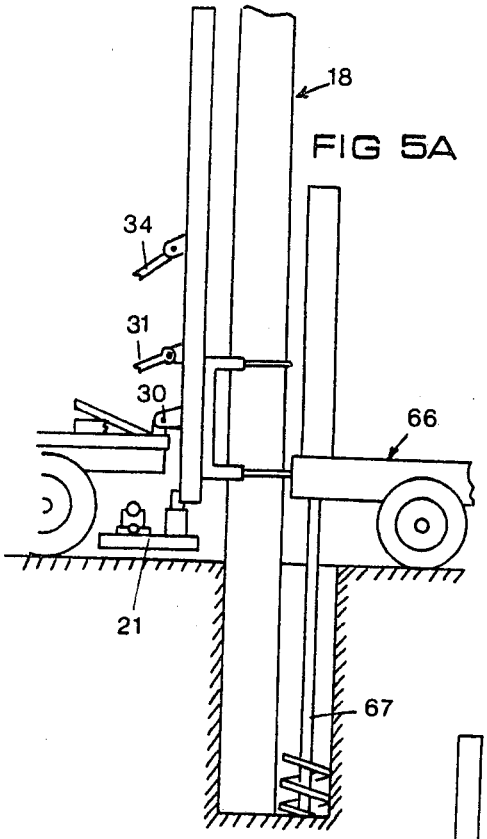
Figure 5B:
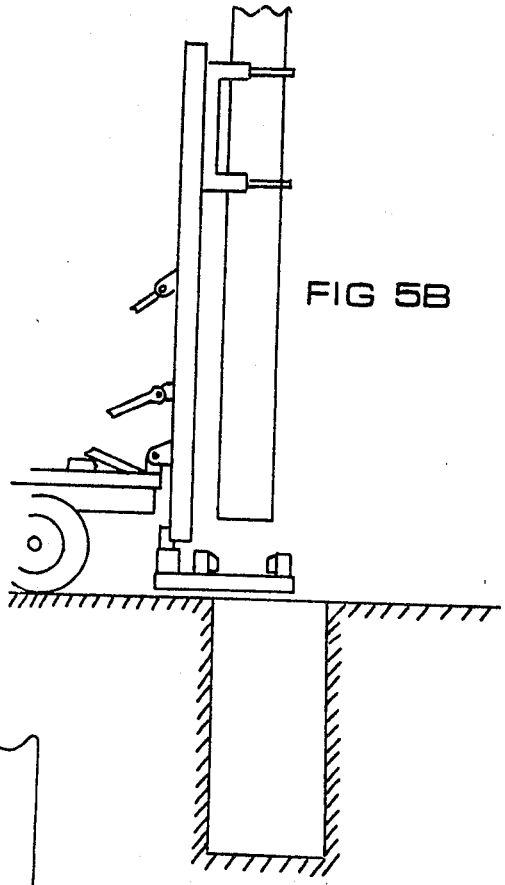
Figure 5C:
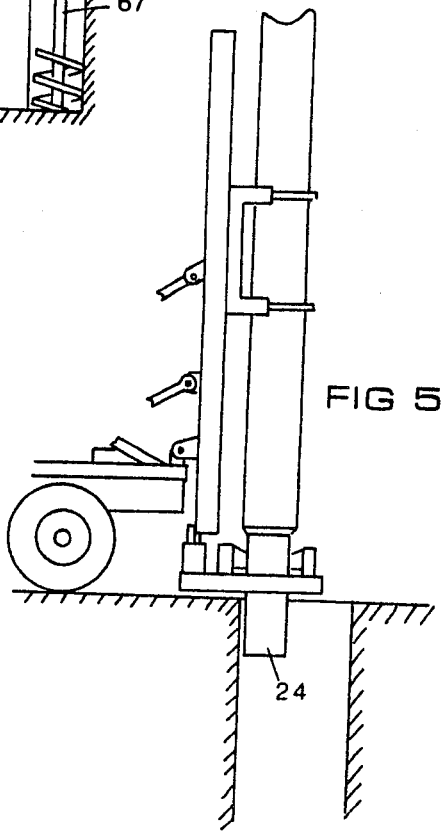
Figure 6A:
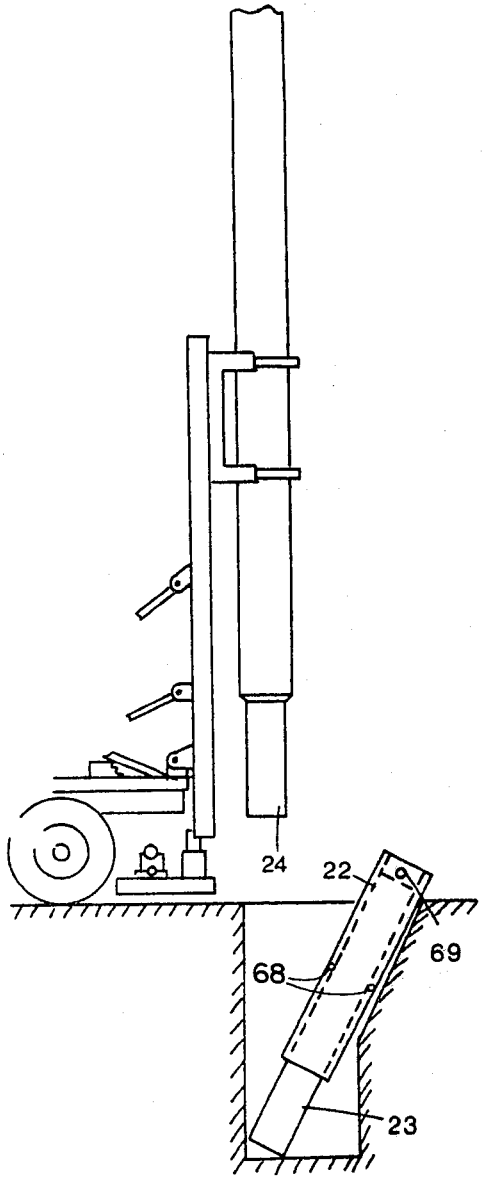
Figure 6B:
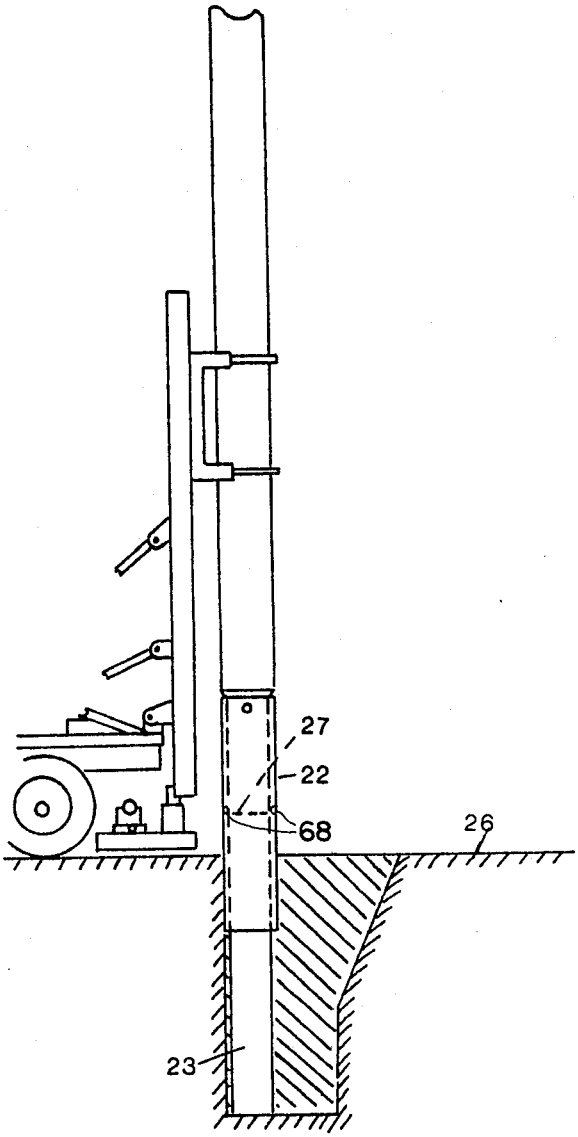

Another truck 66 equipped with drilling means in the form of earth auger 67 is positioned as shown in FIG. 5A to drill a vertical hole alongside and as close as possible to pole 18.

This adjacent hole can be drilled substantially to the same depth as that to which the original pole 18 is buried. After the drilling, auger 67 is removed by at least 2 meters and the pole carefully lifted to the full extent of hoist 35 (usually about 3 meters) during which time the operators may have to exercise great care and vigilance as to the effect of such lifting on the pole, insulators, conductors and adjacent poles. The base of the pole is cleared of any adhering soil and other foreign matter. Pole sizing assembly 21 is then swung into and locked in the operative position (FIG. 5B) underneath pole 18. Cutters 20 having been suitably adjusted e.g. as to the desired diameter, the cutter motors are started and the pole lowered very slowly while moving the cutters one half revolution backwards and forwards around the pole. This sizing is to be effected over such pole length as is to be received by sleeve 22, normally about half the sleeve length. From time to time during the cutting, the pole size and section may be checked with a ring-gauge.

The sizing may include the step, which is not illustrated, of cutting off and removing from the ground a defective base portion of the pole, so that the stub constitutes, in effect, a replacement base. Clearly such a stub must be long enough to account for the severed length plus any desired increase in height and/or depth.

The lower end portion of the pole having been suitably sized, as necessary, assembly 21 is unlocked, swung away and re-locked, and auger 67 moved into position at an angle of about 20° to the vertical. It is then operated so as to drill out a "slotted hole", and to drill deeper should it be desired to bury the refurbished pole to a greater depth. The auger is removed, the hole trimmed up as necessary and the stub is lowered into the hole. The sleeve is then lowered over the stub. To enable the sleeve to be handled with reasonable ease, it may be fitted with lifting eyes fitted within tapped holes in the sleeve. The stub and sleeve are now aligned with the pole and the sleeve lifted relative to the stub until a bar can be inserted in halfway holes 68. Pole 18 is then lowered onto the stub, the lifting eyes removed, and the sleeve turned as necessary to bring electrical earthing attachments on pole 18 into registration with holes or apertures in sleeve 22. When pole and sleeve are in the correct relative position, they may be secured together by coach screws through tapped holes such as 69, and the earthing and other necessary electrical connections made.

The pole and sleeve are lifted sufficiently to enable the aforementioned bar to be removed from between pole and stub, and the pole and sleeve are lowered until the pole rests upon the stub. The hole is back-filled, the filling tamped place and the pole clamps 39, 40 disengaged and removed, the stabilising legs 13, 14 and stays 15, 16 are folded away and the truck(s) 10 (66) can be driven off and the site cleared.

Should it be necessary to restore the pole diameter or cross-section to a required value or configuration e.g. in order to establish a close fit of the pole within the sleeve, the pole material may be filled or augmented such as by a mixture of sand and organic resins or other suitable binding material, advantageously of a granular nature.

A system of "nominal" sleeve and stub diameters may be adopted e.g. in a range of steps in 25 mm increments, the pole being sized down to the next lowest nominal size.

If desired the junction means 22 may be formed integral with, or otherwise as part of, stub 23. For example a combined stub-sleeve might be formed from concrete with the sleeve portion additionally reinforced as desired.

For the purposes of this specification terms such as "upper", "above", "top", "uppermost", "lower", "below", "base", "lowermost", "height", "above" and "below" are to be read as referring to the invention, including the aforementioned truck assembly, in position of use. Such terms, therefore, are not to be read as necessarily limiting.

The claims defining the invention are as follows:

1. An apparatus for repairing a pole used to support a line comprising:

a base frame;

guide means carried by said base frame positionable in a substantially vertical position adjacent a pole to be repaired;

a movable carriage guided by said guide means;

clamp means carried by said carriage for clamping the pole;

means for moving said carriage with respect to said base frame so that the clamped pole is raised and lowered with respect to the base frame; and cutting means carried by said base frame for sizing a lower end portion of a raised pole.

2. The apparatus according to claim 1 wherein the sized lower end portion is positionable in end-to-end abutting relationship with a stub positioned beneath the raised pole, said apparatus further comprising means for positioning junction means in a position encompassing confronting end portions of the pole and stub, the junction means interconnecting the pole and stub so that the stub forms a rigid lower extension of the pole.

* * * * *

UNITED STATES PATENT AND TRADEMARK OFFICE

CERTIFICATE OF CORRECTION

PATENT NO. : 4,371,018

DATED : Feb.1, 1983

INVENTOR(S) : Victor ARNOLD

It is certified that error appears in the above-identified patent and that said Letters Patent are hereby corrected as shown below:

On the title page after [75], insert:

-- [73] Assignee: Austpole Pty. Ltd., Victoria, Australia --.

Signed and Sealed this

*Twenty-first* Day of *August 1984*

[SEAL]

*Attest:*

GERALD J. MOSSINGHOFF

*Attesting Officer*

*Commissioner of Patents and Trademarks*